US006004222A

United States Patent [19]

Moody

[11] Patent Number: 6,004,222

[45] Date of Patent: Dec. 21, 1999

[54] GOLF PUTTER

[76] Inventor: James E. Moody, 15306 Brandonwood Pl., Houston, Tex. 77069

[21] Appl. No.: 09/034,640

[22] Filed: Mar. 4, 1998

[51] Int. Cl.[6] ..... A63B 69/36; A63B 53/02

[52] U.S. Cl. ..... 473/242; 473/313; 473/251

[58] Field of Search ..... 473/305, 313, 473/314, 316, 219, 251, 242

[56] References Cited

U.S. PATENT DOCUMENTS

| | | |
|---|---|---|
| D. 216,031 | 11/1969 | Blake . |
| 669,864 | 3/1901 | Simpson . |
| 3,077,350 | 2/1963 | Koorland . |
| 3,539,184 | 11/1970 | Koorland . |
| 3,967,826 | 7/1976 | Judice . |
| 4,650,191 | 3/1987 | Mills . |
| 5,226,654 | 7/1993 | Solheim . |
| 5,267,733 | 12/1993 | Szokola . |
| 5,292,128 | 3/1994 | Solheim . |
| 5,544,883 | 8/1996 | Meyer . |
| 5,569,098 | 10/1996 | Klein . |
| 5,688,187 | 11/1997 | Duncan . |

*Primary Examiner*—Sebastiano Passaniti
*Attorney, Agent, or Firm*—Jeffrey E. Griffin

[57] ABSTRACT

The present invention provides a golf putter having a shaft attached to the club face of the head by a hosel. The hosel is attached to the face with the bottom of the hosel flush with the bottom of the head and the bottom of the face. The hosel maintains the face and the shaft in spaced parallel planes to define a space between the face and the shaft. The hosel may have a circular cross sectional shape or another cross sectional shape that allows the golfer to better see the bottom of the hosel. The present invention provides a golf putter that allows the golfer to clearly see the bottom of the hosel and, thus, gauge the distance to the ground and the bottom of the golf putter so that the golfer can know how far he may come up in the stroke to apply a top spin to the golf ball without topping the ball and allows the golfer to apply a pulling stroke rather than a pushing stroke.

17 Claims, 1 Drawing Sheet

GOLF PUTTER

BACKGROUND OF THE INVENTION

1. Field of Invention

The present invention relates to the field of sports equipment. More specifically, the invention relates to an improved golf putter that enables the golfer to better visualize the distance to the ground and the distance to the bottom of the club face, to better align the golf ball with the putter, and to provide a desired pulling stroke.

2. Related Art

Golf is a game of skill that requires concentration and focus making the mental portion of the game as important as the physical aspects. In some cases, the mental and physical aspects of golf intertwine. For example, when striking a golf ball the club head should strike the golf ball with the club face perpendicular to the swing travel path and with the club head striking the ball in the "sweet spot" of the club head. Variations in angle and striking location can cause the ball to travel along undesirable paths. This principle is true not only on the fairway, but also when putting on the green.

When putting, it is desirable to strike the golf ball in the sweet spot of the club head with the club face perpendicular to the desired travel path. A proper stoke preferably produces a slight top-spin on the ball. Although simple in principle, providing the correct amount of force to the ball in the proper direction with the proper spin is difficult in practice and may cause extreme frustration to amateurs and professionals alike. Often, problems with putting may be overcome with training, enhanced concentration, change of grip, approach, or stroke, or change of visualization or touch. For example, attempting to use or visualize a pulling motion, rather than a pushing motion, may improve the resulting putt. Due to the difficulty of putting, many styles and sizes of putters have been developed and used with some having traditional shafts and grips and some having modified shafts and grips. The existing putters vary in weight, balance, size, shape, hosel positioning, etcetera to allow the individual golfer to find the exact style with which he feels most comfortable. Some of the variations are tangible, such as a larger sweet spot, while others are less tangible, such as the weight of the club.

However, despite the use of the prior art features, there remains a need for additional putters. In particular, there remains a need for a putter that allows the golfer to better visualize and gauge the distance to the ground and the distance to the bottom of the club face, which is also generally the bottom plane of the golf ball, allowing the golfer to know how far the golfer may bring the putter from the bottom of the swing up in the stroke to impart a solid hit without fear of topping the ball facilitating placing the desired top-spin on the ball.

SUMMARY OF THE INVENTION

To achieve such improvements, the present invention provides a golf putter adapted to allow the golfer to better gauge the distance to the ground, the distance to the bottom of the club face, and the golf ball's bottom plane and to allow the golfer to know how far he may come up in the stroke to impart a solid hit on the ball without topping the ball. In general, the golf putter has a shaft attached to a club head by a hosel. The hosel attaches to the face of the head with the bottom of the hosel flush with the bottom of the head and the bottom of the face. The hosel extends out from the face of the putter to maintain the shaft and the face in spaced parallel planes and to define a space allowing the golfer to clearly see the end of the hosel to gauge the distance to the ground and the distance to the bottom of the club face. The attachment of the hosel to the face of the head allows the golfer to pull the club head rather than push the head. Allowing the golfer to properly gauge the distance to the ground, the distance to the bottom of the club face, and the distance to the bottom of the golf ball, the golfer can impart the desired top-spin on the ball without the fear of topping the ball giving a solid hit on the golf ball.

One aspect of the present invention provides a golf putter that has an elongated shaft and a head that has a face adapted for striking a golf ball, wherein the head and the face each have a bottom. A hosel connects one end of the shaft to the face of the head with a bottom of the hosel flush with the bottom of the face and the bottom of the head. Preferably, the attachment of the hosel to the face of the head extends no more than about sixty percent of the height of the face and, more preferably, no more than about twenty percent of the height of the face. The hosel is preferably adapted to maintain the shaft and the face of the head in spaced parallel planes so that the hosel defines a space between the shaft and the face. The space between shaft and the face is preferably at least about ¼ inches to at least about ⅝ inches.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

The present invention generally provides a golf putter adapted to allow the golfer to better gauge the distance to the ground and the distance to the bottom of the club face and allow the golfer to know how far he may come up in the stroke to impart a solid hit on the ball without topping the ball. In general, the golf putter has a shaft attached to a club head by a hosel. The hosel attaches to the face of the head with the bottom of the hosel flush with the bottom of the head and the bottom of the face. The hosel extends out from the face of the putter to maintain the shaft and the face in spaced parallel planes and to define a space allowing the golfer to clearly see the end of the hosel to gauge the distance to the ground and the distance to the bottom of the club face. The attachment of the hosel to the face of the head also allows the golfer to pull the club head rather than push the head. Knowing the distance to the ground and the distance to the bottom of the club face, which generally coincides with the bottom of the golf ball, the golfer can impart the desired top-spin on the ball without the fear of topping the ball.

Although it is possible and anticipated to connect the shaft directly to the club head without using a hosel, for clarity of description, the following description describes a golf putter including a hosel. However, as used herein, the hosel may comprise a separate member or may comprise an end of the shaft.

Figure 1:
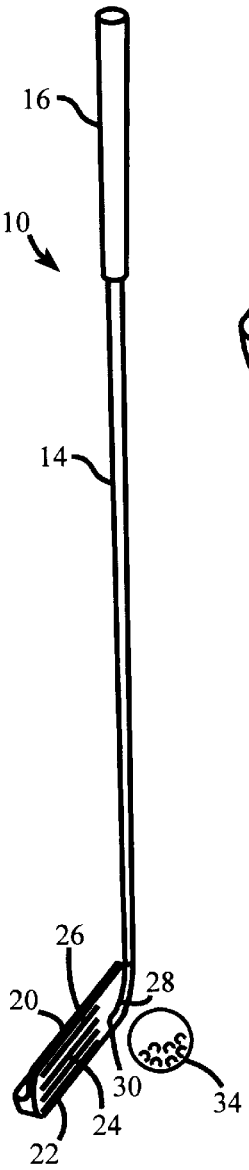
FIG. 1 is a perspective view of the golf putter and a golf ball.
Figure 2:
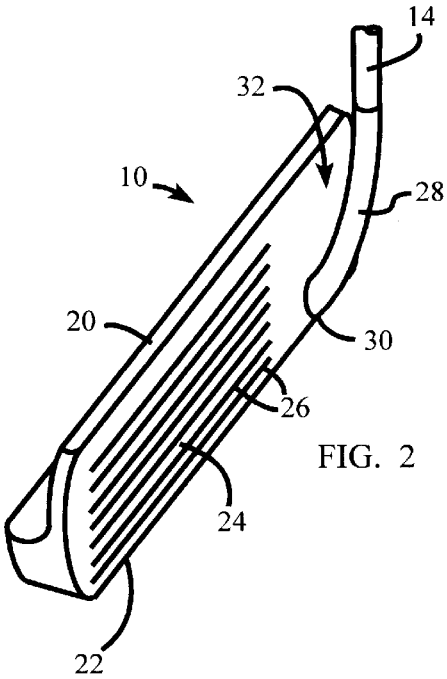
FIG. 2 is a partial perspective view of the head, hosel, and a portion of the shaft of the golf putter.

FIGS. 1 and 2 are perspective views of the golf putter 10. The golf putter 10 provides an elongated shaft 14, a head 20, and a hosel 28 connecting the shaft 14 to the head 20. The shaft 14 has opposing ends with the lower end attached to the hosel 28 and the upper end adapted to be gripped by a golfer. The upper end typically includes a grip 16 designed to enhance the golfer's grip on the club. The shaft 14 is formed of a substantially rigid material and is sized to withstand the forces generally encountered during putting. Also, the shaft 14 is straight and typically has a circular outer cross sectional shape although other shaft shapes are anticipated. The shaft 14 may be adapted for a standard grip or for other grips wherein, for example, the shaft 14 is relatively long and is gripped with the golfer's hands spread apart from one another.

The club head 20 defines a club face 24 adapted for striking the golf ball 34. The head 20 is substantially rigid and designed to withstand the force typically encountered in putting a golf ball 34. The club head 20 may take any variety of shape or style with typical variations occurring in face size, club weight, weight distribution, shape, aesthetics, and the like. Likewise the face 24 of the club may take a variety of shapes and may have varying features such as ridges 26 therein adapted to increase the friction between the club face 24 and the golf ball 34. Preferably, the club face 24 is substantially flat and lies within a substantially vertical plane when in use.

The hosel 28 connects the lower end of the shaft 14 to the head 20. More specifically, the hosel 28 connects the lower end of the shaft 14 to the face 24 of the club head 20. By connecting the shaft 14 to the face 24 of the club head 20, the golfer pulls the head 20 through the swing rather than pushing the head 20 through the swing. Pulling the head 20 through the swing is preferred and the present invention assists the golfer in visualizing a pulling, rather than a pushing, motion.

Preferably, the bottom 30 of the hosel 28 is flush with the bottom 22 of the face 24 and the bottom 22 of the head 20. By aligning the bottom 30 of a hosel 28 with the bottom 22 of the face 24, the distance to the ground and the distance to the bottom 22 of the club face 24 are accurately reflected by hosel 28. Thus, a golfer using the golf putter 10 may look down the shaft 14 to the end of the hosel 28 and accurately gauge the distance to the ground and the distance to the bottom 22 of the club face 24. To enhance the ability of the golfer to accurately gauge the distance to the ground and the distance to the bottom 22 of the club face 24, the attachment of the hosel 28 to the face 24 of the head 20 preferably extends no more than about 20 percent to no more than about 60 percent of the height of the face 24 of the head 20. Preferably, a hosel attachment to the face 24 covers as little surface area of the face 24 as possible without jeopardizing the stability of the golf putter 10. Reducing the height of the hosel attachment allows the golfer to better gauge the distance to the ground and the distance to the bottom 22 of the club face 24 because a larger hosel attachment tends to obscure the view to the bottom 30 of the hosel 28. The height of the hosel attachment is measured from the bottom 30 of the attachment of the hosel 28 to the face 24 to the top of the attachment of the hosel 28 to the face 24. With a small hosel attachment height, the golfer may better gauge the distance to the bottom 22 of the face 24 even when the golfer can only see the top of the hosel attachment or the widest diameter of the hosel attachment. The better the golfer may see and gauge the bottom 30 of the hosel 28, the better the golfer can gauge the distance to the ground and the distance to the bottom 22 of the club face 24.

Figure 3:
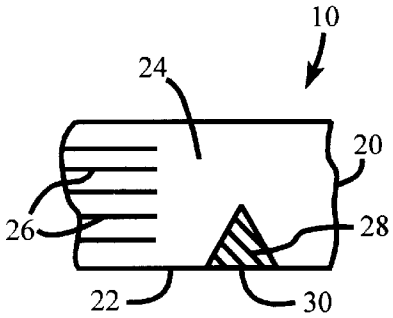
FIG. 3 is a partial side cross sectional view of the golf putter showing an alternative hosel shape.
Figure 4:
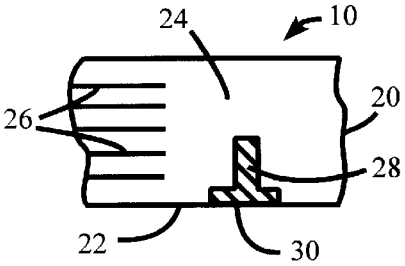
FIG. 4 is a partial side cross sectional view of the golf putter showing another alternative hosel shape.

Typically, the hosel 28 has a circular cross section. However, the hosel 28 may have virtually any cross sectional shape. For example, if a cross sectional shape of the hosel 28 is triangular so that the base, or bottom 30, of the hosel 28 is a wider than the top of hosel 28, the golfer may be able to better judge the location of the hosel bottom 30 because the golfer is able to see the very bottom 30 of the hosel attachment and, thus, the bottom 22 of the club head 20 and club face 24. FIG. 3 is a side cross sectional view showing the triangular hosel 28. Likewise, FIG. 4 shows another alternative design for the hosel 28. In this second alternative design, the hosel attachment has the shaped of an inverted T that defines a base, or bottom 30, that is much wider than the top of the hosel 28. The wider hosel bottom 30 allows the golfer to visualize the distance to the bottom 30 of the hosel 28, the distance to the ground, and the distance to the bottom 22 of the club face 24. Accordingly, there are a number of possible alternative designs for a hosel 28 in which the base, or bottom 30, is wider than the top of the hosel 28 allowing the golfer to better see the bottom 30 of the hosel 28 and thus better gauge the distance to the ground and the distance to the bottom 22 of the club face 24. These other alternative designs are anticipated and include, inter alia, an L shaped hosel 28, a trapezoid shaped hosel 28, a parallelogram shaped hosel 28, or any other hosel shape wherein the bottom 30 of the hosel 28 is wider than the other portions of the hosel 28 or is otherwise visible to a golfer when the club is in use. Although the hosel 28 may have the specialized hosel shape throughout its length, the hosel 28 may alternatively have only a portion near the hosel attachment to the face 24 that has a special, non-circular shape.

Figure 5:
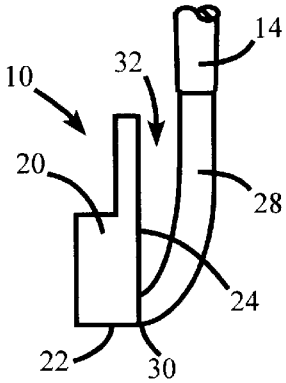
FIG. 5 is a partial front elevational view of the golf putter.
Figure 6:
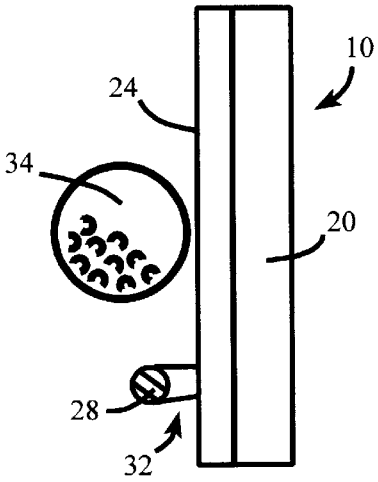
FIG. 6 is a partial top view of the golf putter aligned with a golf ball.

FIG. 5 is a front elevational view of the golf putter 10 showing the attachment of the hosel 28 to the face 24 of the putter 10. The hosel 28 extends out from the face 24 of the putter 10 and maintains the face 24 of the club head 20 and the shaft 14 in spaced parallel planes so that the hosel 28 defines a space 32 between the shaft 14 and the face 24. As used herein the term spaced parallel planes shall mean that the axis of the shaft 14 lies in a plane that is generally parallel with the club face 24 although slight variances in the angle between the planes, such as variances due to a small angle of the club face 24 to the vertical plane, are allowable. The primary importance in the spacing being that the hosel 28 creates a space 32 between the shaft 14 and the club face 24 that is sufficiently wide that the golfer may look down along the shaft 14 and clearly see the attachment of the hosel 28 to the club face 24 and accurately gauge the distance to the bottom 30 of the hosel 28. Preferably, the space 32 between the shaft 14 and the face 24 is at least about ¼ inches to at least about ⅝ inches. This preferred spacing is typically sufficient to allow the golfer to clearly view the attachment of the hosel 28 to the face 24. FIG. 6 illustrates the golfer's view of the hosel 28 and how the space 32 allows the golfer to clearly see the bottom 30 of the hosel 28 and, thus, accurately gauge the distance to the ground and the distance to the bottom 22 of the club face 24.

Therefore, in use, the golfer holds the golf putter 10 in an aligned position with the golf ball 34 and looks down along the shaft 14 to the hosel 28. By looking at the hosel 28 the golfer is able to accurately gauge the distance to the ground and the bottom 22 of the club face 24. Thus, during the stroke the golfer knows how far up he may bring the club in the stroke to impart a top-spin and a solid hit to the golf ball 34 without topping the ball 34. In this way, the golf putter 10 of the present invention improves accuracy in putting.

While the foregoing is directed to the preferred embodiment of the present invention, other and further embodiments of the invention may be devised without departing from the basic scope thereof, and the scope thereof is determined by the claims which follow.

I claim:

1. A golf putter, comprising:

an elongated shaft;

a head having a face adapted for striking a golf ball, the head and the face each having a bottom;

a hosel connecting one end of the shaft to the face of the head;

a bottom of the hosel flush with the bottom of the face and the bottom of the head;

the bottom of the hosel is wider than the remainder of the hosel; and so that a user may more easily determine the location of the bottom of the hosel and, thus, the bottoms of the face and the head with respect to the ball and the ground.

2. The golf putter as claimed in claim 1, wherein the attachment of the hosel to the face of the head extends along a plane containing the face no more than fifty percent of the height of the face.

3. The golf putter as claimed in claim 1, wherein the attachment of the hosel to the face of the head extends along a plane containing the face no more than forty percent of the height of the face.

4. The golf putter as claimed in claim 1, wherein the attachment of the hosel to the face of the head extends along a plane containing the face no more than thirty percent of the height of the face.

5. The golf putter as claimed in claim 1, wherein the attachment of the hosel to the face of the head extends along a plane containing the face no more than twenty percent of the height of the face.

6. The golf putter as claimed in claim 1, wherein the hosel is adapted to maintain the shaft and the face of the head in spaced parallel planes so that the hosel defines a space between the shaft and the face.

7. The golf putter as claimed in claim 6, wherein the space between the shaft and the face is at least about ¼ inch.

8. The golf putter as claimed in claim 6, wherein the space between the shaft and the face is at least about ⅝ inch.

9. The golf putter as claimed in claim 1, wherein at least a portion of the hosel has a non-circular shape.

10. The golf putter as claimed in claim 9, wherein the at least a portion of the hosel has a non-circular shape is a portion of the hosel proximal the face of the head.

11. The golf putter as claimed in claim 1, wherein at least a portion of the hosel has a triangular shape.

12. The golf putter as claimed in claim 1, wherein at least a portion of the hosel has an inverted T shape.

13. The golf putter as claimed in claim 1, wherein at least a portion of the hosel is shaped and adapted to allow a golfer using the golf putter to see the bottom of the hosel.

14. A golf putter, comprising:

an elongated shaft;

a head having a face adapted for striking a golf ball, the head and the face each having a bottom;

a hosel connecting one end of the shaft to the face of the head;

a bottom of the hosel flush with the bottom of the face and the bottom of the head; and the attachment of the hosel to the face of the head extends along a plane containing the face no more than fifty percent of the height of the face; and so that attachment of the hosel to the face of the head lowers the center of mass of the head below the geometric center of the head.

15. The golf putter as claimed in claim 14, wherein the attachment of the hosel to the face of the head extends along a plane containing the face no more than forty percent of the height of the face.

16. The golf putter as claimed in claim 14, wherein the attachment of the hosel to the face of the head extends along a plane containing the face no more than thirty percent of the height of the face.

17. The golf putter as claimed in claim 14, wherein the attachment of the hosel to the face of the head extends along a plane containing the face no more than twenty percent of the height of the face.

* * * * *